US009476241B2

(12) United States Patent
Meves et al.

(10) Patent No.: US 9,476,241 B2
(45) **Date of Patent: *Oct. 25, 2016**

(54) KEY LOCKABLE OPERATOR COVER

(71) Applicant: Truth Hardware Corporation, Owatonna, MN (US)

(72) Inventors: Donald Collins Meves, Owatonna, MN (US); Sherry Lynn Jones, Owatonna, MN (US); Michael L. Scott, Owatonna, MN (US); Gregory J. Vetter, Owatonna, MN (US)

(73) Assignee: Truth Hardware Corporation, Owatonna, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/664,557

(22) Filed: Mar. 20, 2015

(65) Prior Publication Data

US 2015/0259963 A1 Sep. 17, 2015

Related U.S. Application Data

(63) Continuation of application No. 13/838,012, filed on Mar. 15, 2013, now Pat. No. 9,003,706.

(51) Int. Cl.

| | |
|---|---|
| ***E05B 65/00*** | (2006.01) |
| ***E05F 11/10*** | (2006.01) |
| ***E05F 11/34*** | (2006.01) |
| ***E05B 13/00*** | (2006.01) |
| ***E05B 17/04*** | (2006.01) |
| ***E05F 9/00*** | (2006.01) |
| ***E05F 11/32*** | (2006.01) |

(52) U.S. Cl.

CPC ..... *E05F 11/10* (2013.01); *E05B 13/002* (2013.01); *E05B 17/042* (2013.01); *E05B 65/0025* (2013.01); *E05F 9/00* (2013.01); *E05F 11/32* (2013.01); *E05F 11/34* (2013.01); *E05Y 2201/22* (2013.01); *E05Y 2900/148* (2013.01); *Y10T 70/5146* (2015.04)

(58) Field of Classification Search

CPC ..... E05F 11/00; E05F 9/00; E05F 11/32; E05B 65/0025; E05B 13/002; Y10T 292/57; Y10T 70/5761; Y10T 16/473; Y10T 74/20756

USPC ..... 49/246–261; 292/139, 142, 177, 179, 292/279, 336.3, DIG. 20, DIG. 31, DIG. 33; 70/89, 90, 208–210, DIG. 31

See application file for complete search history.

(56) References Cited

U.S. PATENT DOCUMENTS

| | | | | | |
|---|---|---|---|---|---|
| 2,317,700 | A | * | 4/1943 | Thompson | 292/254 |
| 3,007,348 | A | * | 11/1961 | Barnes | 74/547 |
| 3,745,796 | A | * | 7/1973 | Fleming | 70/81 |
| 4,135,376 | A | * | 1/1979 | Evans et al. | 70/100 |
| 4,155,589 | A | * | 5/1979 | Kouth | 296/214 |
| 4,502,716 | A | * | 3/1985 | Tsai | 292/142 |

(Continued)

*Primary Examiner* — Justin Rephann

(74) *Attorney, Agent, or Firm* — Patterson Thuente Pedersen, P.A.

(57) ABSTRACT

A key lockable window operator, including a crank handle that is shiftable between a folded storage position and an unfolded operating position and a lock cylinder operably engaged to a rack and a sliding pin. The rack and the sliding pin are shiftable between an unlocked position and a locked position. When in the locked position, at least a portion of the sliding pin is engaged into a cavity in the crank handle whereby the crank handle is secured in the folded storage position.

6 Claims, 9 Drawing Sheets

(56) References Cited

U.S. PATENT DOCUMENTS

| | | | | |
|---|---|---|---|---|
| 4,631,937 | A * | 12/1986 | Debus et al. | 70/207 |
| 4,898,408 | A * | 2/1990 | Hauber | 292/7 |
| 5,195,395 | A * | 3/1993 | Wagner | 74/557 |
| 5,407,044 | A * | 4/1995 | Grimm et al. | 192/139 |
| 5,560,082 | A * | 10/1996 | Vetter | 16/429 |
| 5,740,632 | A * | 4/1998 | Peterson et al. | 49/460 |
| 6,164,156 | A * | 12/2000 | Purcell | 74/547 |
| 6,182,483 | B1 * | 2/2001 | von Kathen et al. | 70/208 |
| 6,363,761 | B1 * | 4/2002 | Sauerland | 70/208 |
| 6,418,762 | B1 * | 7/2002 | Munch et al. | 70/208 |
| 6,427,501 | B2 * | 8/2002 | Ramsauer | 70/208 |
| 6,450,063 | B1 * | 9/2002 | Harvey et al. | 74/547 |
| 6,546,764 | B2 * | 4/2003 | Segawa | 70/208 |
| 6,598,265 | B2 * | 7/2003 | Lee | 16/429 |
| 6,637,785 | B2 * | 10/2003 | Sugimoto | 292/336.3 |
| 6,640,389 | B2 * | 11/2003 | Van Klompenburg et al. | 16/429 |
| 6,971,689 | B2 * | 12/2005 | Jackson | 292/336.3 |
| 6,983,962 | B2 * | 1/2006 | Keightley | 292/144 |
| 7,066,505 | B2 * | 6/2006 | Van Klompenburg et al. | 292/336.3 |
| 7,096,697 | B2 * | 8/2006 | Keightly | 70/279.1 |
| 7,251,860 | B2 * | 8/2007 | Liang et al. | 16/429 |
| 7,941,898 | B2 * | 5/2011 | Liang et al. | 16/429 |
| 2002/0066162 | A1 * | 6/2002 | Klompenburg et al. | 16/429 |
| 2006/0032143 | A1 * | 2/2006 | Johnson | 49/341 |
| 2007/0273162 | A1 * | 11/2007 | Schultz | 292/336.3 |
| 2008/0066382 | A1 * | 3/2008 | Erickson | 49/246 |
| 2009/0256367 | A1 * | 10/2009 | Schultz | 292/336.3 |
| 2013/0312331 | A1 * | 11/2013 | Bourgoin | 49/359 |
| 2014/0053678 | A1 * | 2/2014 | Gottschling et al. | 74/523 |
| 2014/0069016 | A1 * | 3/2014 | Perry et al. | 49/31 |

* cited by examiner

FIG. 6
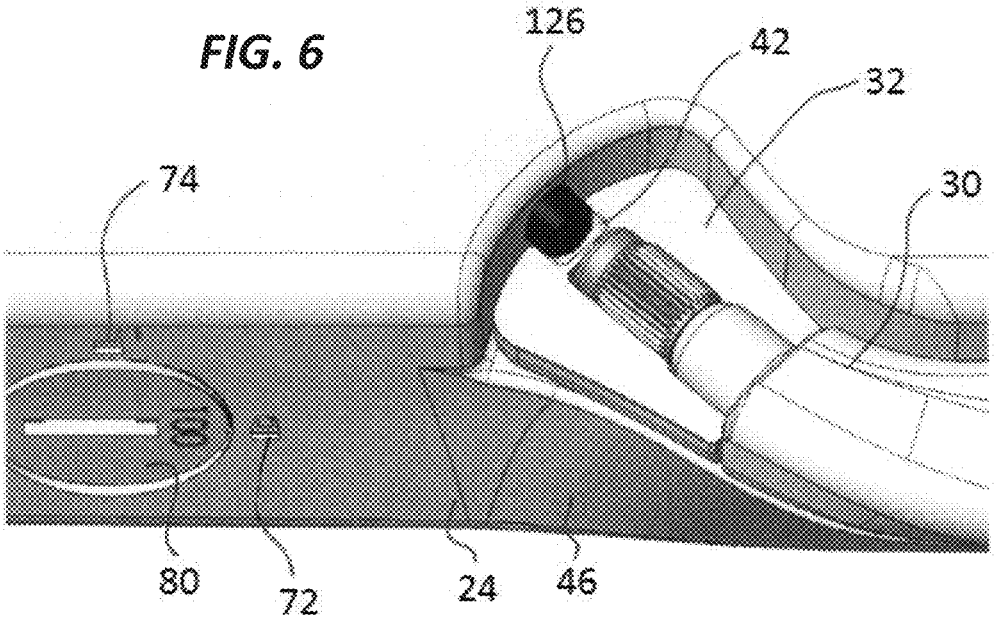
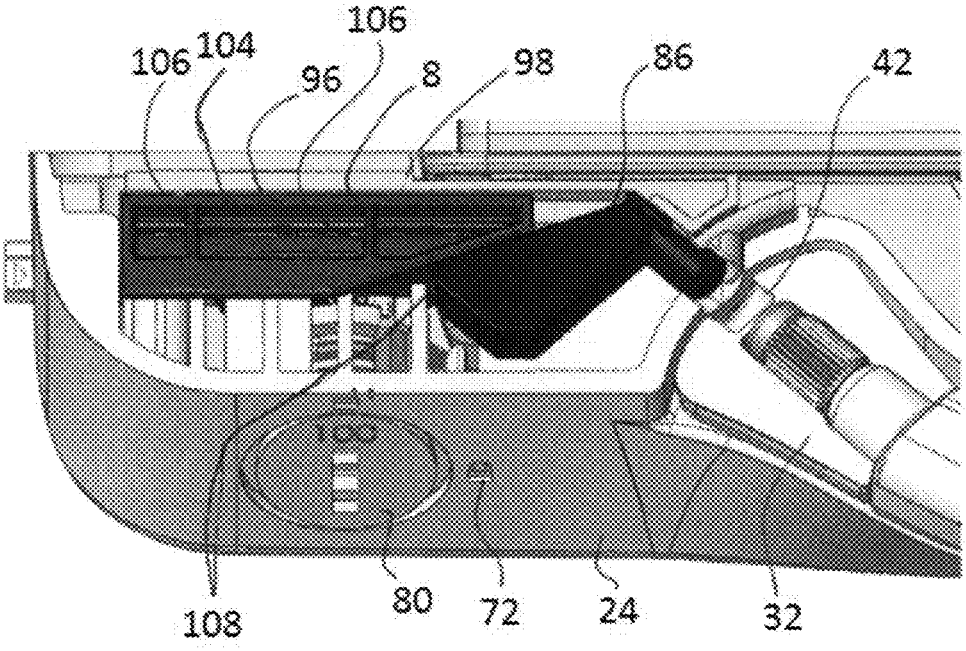
FIG. 7

KEY LOCKABLE OPERATOR COVER

RELATED APPLICATIONS

This application is a Continuation of U.S. application Ser. No. 13/838,012, filed Mar. 15, 2013, said application being hereby incorporated herein by reference in its entirety.

FIELD OF THE INVENTION

The invention relates to operators for casement and awning windows. More particularly, the invention relates to operators for casement and awning windows that are lockable to prevent operation of the window by unauthorized persons.

BACKGROUND OF THE INVENTION

Many windows are located in publicly accessible places. Yet, it may be undesirable for the windows to be situated so that anyone can operate the windows to open and close them at any time. Unauthorized opening of windows may permit unauthorized access to the building and can also create safety concerns particularly in buildings where children are present. Accordingly, various schemes are available so that a window may be locked in either an open, closed or partially open condition and can only operated by authorized persons such as custodians.

A casement or an awning window generally refers to a sash that is attached to its frame by one or more hinges. The hinges can be located on any side of the sash and the frame though generally not on the lower edge of the sash and frame. In general, a casement window rotates along a horizontal plane (the hinges of a casement window defining a vertical rotation axis), while an awning window rotates along a vertical plane (the hinges of an awning window defining a horizontal rotation axis). Most casement and awning windows which employ the use of a crank lever or cam handle operator open outwardly so as not to interfere with the operator of the window.

An advantage of many casement and awning windows is that substantially the full window opening can be exposed without requiring the removal of the window from the frame. In contrast, for example only half of the opening of a double-hung window can be exposed by raising the lower sash or lowering the upper sash. The sashes of double hung or horizontally sliding windows must be completely removed from the frame to expose the entire window opening Window operators for casement or awning windows often have a folding handle that is freely moveable from a folded position in which the handle is nestled into a cover of the operator to an operating position in which the handled is movable to crank the window open or closed.

There exists, in the prior art, a casement or awning window operator with a folding handle and a cover with a key cylinder located in the cover. Rotation of the key approximately 180° actuates a sleeve that can be extended and retracted. When in the extended position, the sleeve covers a part of the handle knob thus preventing the handle from being moved from a folded position to an operating position in which it may be used as a crank to open and close the window. According to the prior art, the sliding sleeve is actuated by a pin at the end of the key cylinder.

While the prior art locking operator cover secures the crank of the operator handle by covering it with the retractable sleeve, the retractable sleeve is fully visible and accessible from outside of the operator cover and may be subject to tampering because of this visibility and accessibility. Accordingly, there is still room for improvement in the lockable window operator arts.

SUMMARY OF THE INVENTION

The invention substantially addresses the aforementioned needs of the industry. A key lockable operator, according to an example embodiment of the invention, generally includes a handle and a housing. According to known prior art operators, the handle is typically engaged to a worm gear which engages a gear coupled to an operating arm which is moved arcuately to open and close the casement or awning window. According to an example embodiment of the invention, the handle generally includes a crank, a knob, a hinge, a base and an axle which is coupled to the worm gear. The crank, hinge, base and axle according to the invention are generally conventional with those utilized in the prior art. The knob of the key lockable operator according to the invention includes a body that presents a pin receiving cavity at an end thereof.

The housing according to an example embodiment of the invention generally includes a base portion and a cover.

The base generally includes a plate having mounting holes for mounting on a window frame, lock cylinder supports and a pinion spring. The plate and mounting holes are generally conventional. The lock cylinder supports are formed in the base to support a lock cylinder according to the present invention. The pinion spring is coupled to the base and positioned to engage a portion of the lock cylinder assembly and to act as a detent to the lock cylinder.

The cover generally includes a body and a lock assembly. The cover body generally presents a lock cylinder block. The body also may present indicia indicating when the lock cylinder is locked and unlocked as well as a pin passage through which a pin to secure the cover body to the base of the housing is passed. According to an example embodiment of the invention, the body includes a detent adapted to engage a detent groove in the pin.

The lock assembly generally includes a lock cylinder, a pinion, a rack and a sliding pin.

According to an example embodiment of the invention, the pinion is engaged to an internal end of the lock cylinder so that when the lock cylinder is turned the pinion turns therewith. The pinion generally includes a toothed portion and a smooth portion about the circumference thereof. The pinion may also have teeth continuously around the circumference thereof. The pinion also includes a pair of parallel ridges defining a spring space along a circular surface thereof that is opposed to the end of the pinion engaged to the lock cylinder.

The rack, according to an example embodiment of the invention, generally includes a rack portion and a ramp portion. The rack is generally a unitary structure formed in one piece and also presents a flange, a recess and reinforcements within the recess. The rack also presents a pin engagement rail along the ramp portion thereof. The pin engagement rail includes an outwardly extending portion extending outwardly from the ramp and an upwardly extending portion extending upwardly from the outwardly extending portion.

The sliding pin is also a generally unitary structure and generally presents a pin extension extending outwardly from a body. The body, according to one example embodiment of the invention, has a generally irregular hexagonal shape and presents a rack engagement slot along one edge thereof. The body may also present a ridge extending therefrom to engage the cover.

The lock assembly is supported within the body of the cover so that the lock cylinder is engaged actually with the pinion. The pinion turns with the lock cylinder.

The rack is positioned so as to be engaged with the pinion so that as the lock cylinder is turned, the rack is moved linearly.

The ramp portion of the rack is engaged to the rack engagement slot of the body of the sliding pin via the pin engagement rail which is engaged within the rack engagement slot of the sliding pin. Thus, as the rack is linearly moved, the sliding pin is also linearly moved but on an axis that is at diagonal to the motion of the rack. As the sliding pin is linearly moved, the pin extension is extended or retracted. When the pin extension is in the extended position, it engages the pin receiving cavity of the knob thus securing the knob in a folded position. Accordingly, when the lock cylinder is in the locked position, the knob of the crank is secured within the recess of the cover body and cannot be unfolded to operate the lockable operator. When it is desired to operate the lockable operator, the key is inserted into the lock cylinder and the lock cylinder is rotated to the unlocked position thus retracting the rack and, thereby, retracting the sliding pin and freeing the knob so that is can be folded to the operating position and used to operate the window.

Generally, operator covers are secured by a snap system. In the case of a lockable operator it is undesirable if the operator cover can be removed by merely unsnapping it. Accordingly, the pin engaged in the pin passage of the cover can be pressed inwardly to secure the cover to the housing thus making the cover and the base securely assembled to one another and inhibiting tampering with the lock assembly. The pin includes a detent groove which engages a detent in the cover body when the pin is fully inserted into the cover body. Accordingly, once the pin is advanced and the detent is engaged, the cover body cannot be easily removed from the base of the housing.

In an embodiment, a casement window system includes a frame, a sash hinged to the frame and shiftable between a window closed position in which the sash is received in the frame and a window open position in which the sash is swung outwardly from the frame. A window operator operably couples the frame and the sash and is arranged to shift the sash between the window open and the window closed position. The window operator includes a housing, an arm mechanism, and a crank handle for operating the arm mechanism to shift the sash between the window open and the window closed position, the handle being shiftable between a folded storage position and an unfolded operating position. The operator further includes a handle locking mechanism in the housing, the handle locking mechanism operable with a key to shift between a locked position in which a portion of the mechanism engages and retains the crank handle in the folded storage position and an unlocked position in which the crank handle is freely shiftable between the folded storage position and an unfolded operating position.

In an embodiment, the handle locking mechanism includes a lock cylinder operably coupled to a rack and a sliding pin, the sliding pin engaging the crank handle when the crank handle is in the folded storage position. The lock cylinder may be coupled with a pinion, the pinion engaged with the rack.

In an embodiment, the housing defines a recess for receiving the crank handle when the crank handle is in the folded position. The handle locking mechanism may include a lock cylinder operably coupled to a rack and a sliding pin, the sliding pin engaging the crank handle when the crank handle is received in the recess. The crank handle can present a distal end defining a recess, the sliding pin engaging in the recess defined in the distal end of the crank handle. The lock cylinder may be coupled with a pinion, the pinion engaged with the rack.

In an embodiment, a key lockable window operator includes a crank handle that is shiftable between a folded storage position and an unfolded operating position, a lock cylinder operably coupled to a rack and a sliding pin, the rack and the sliding pin being shiftable between an unlocked position and a locked position wherein, when in the locked position, at least a portion of the sliding pin is engaged into a cavity in the crank handle such that the crank handle is secured in the folded storage position.

In an embodiment, the rack shifts position along a first rectilinear path and the sliding pin shifts position along a second rectilinear path that is oriented diagonal with the first rectilinear path.

In an embodiment, the key lockable operator further includes a housing, the housing defining a recess, with the crank handle received in the recess when the crank handle is in the folded storage position. In an embodiment, the lock cylinder is coupled to a pinion, the pinion engaged with the rack.

In a further embodiment, a window operator includes a housing, an arm mechanism, a crank handle for operating the arm mechanism, wherein the handle is shiftable between a folded storage position and an unfolded operating position, and a handle locking mechanism in the housing, the handle locking mechanism operable with a key to shift between a locked position in which a portion of the mechanism engages and retains the crank handle in the folded storage position and an unlocked position in which the crank handle is freely shiftable between the folded storage position and an unfolded operating position.

BRIEF DESCRIPTION OF THE DRAWINGS

The embodiments of the present invention may be more completely understood in consideration of the following detailed description of various embodiments in connection with the accompanying drawings, in which:

FIG. 6 is a detail perspective view similar to FIG. 5, in the locked state;

FIG. 7 is a cut-away perspective view of a locking assembly in the unlocked state;

Figure 1:
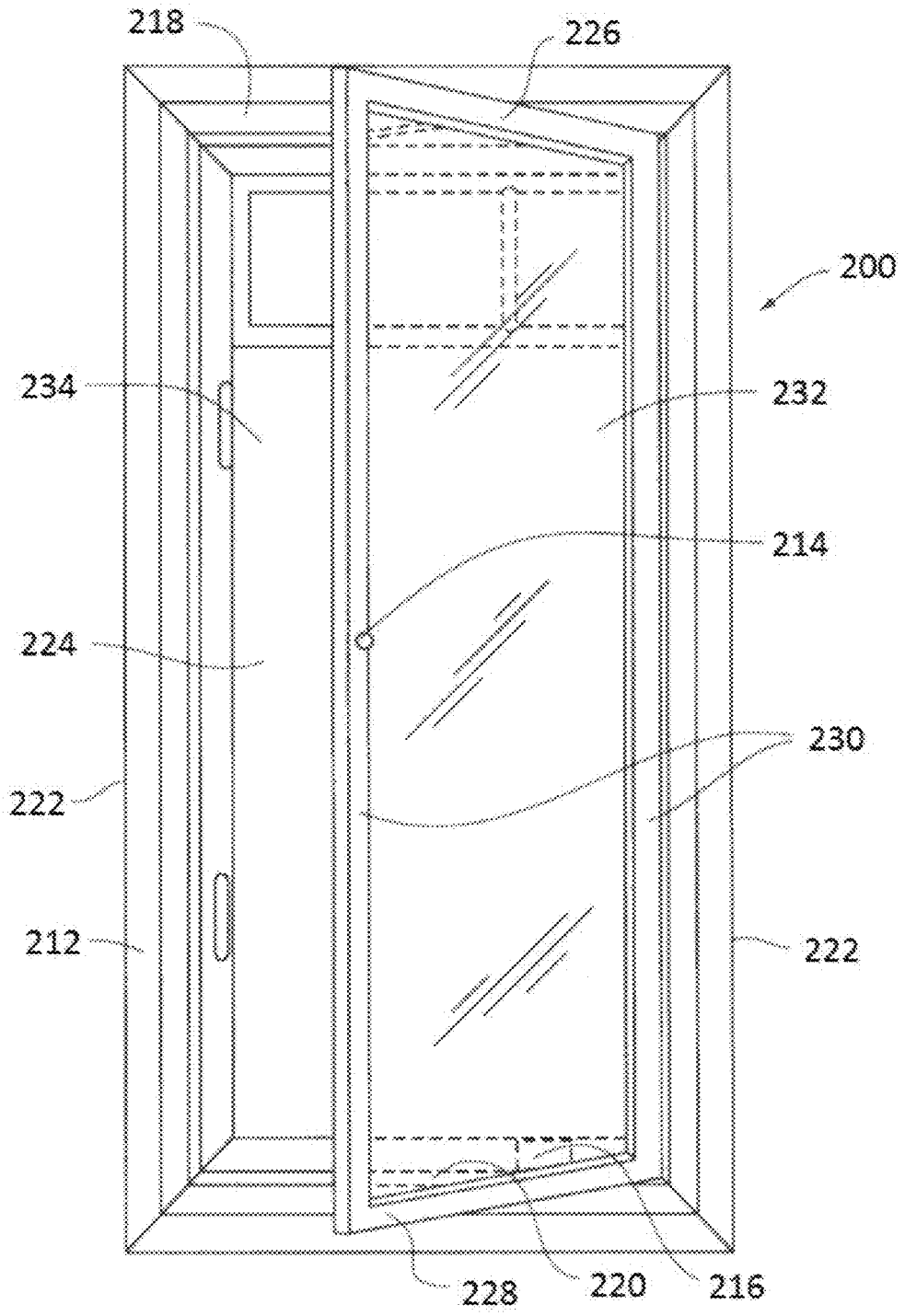
FIG. 1 is a perspective view of an example casement window with which the operator of the present invention may be utilized.

While the present invention is amenable to various modifications and alternative forms, specifics thereof have been shown by way of example in the drawings and will be described in detail. It should be understood, however, that the intention is not to limit the present invention to the particular embodiments described. On the contrary, the intention is to cover all modifications, equivalents, and alternatives falling within the spirit and scope of the present invention.

DETAILED DESCRIPTION

Figure 2:
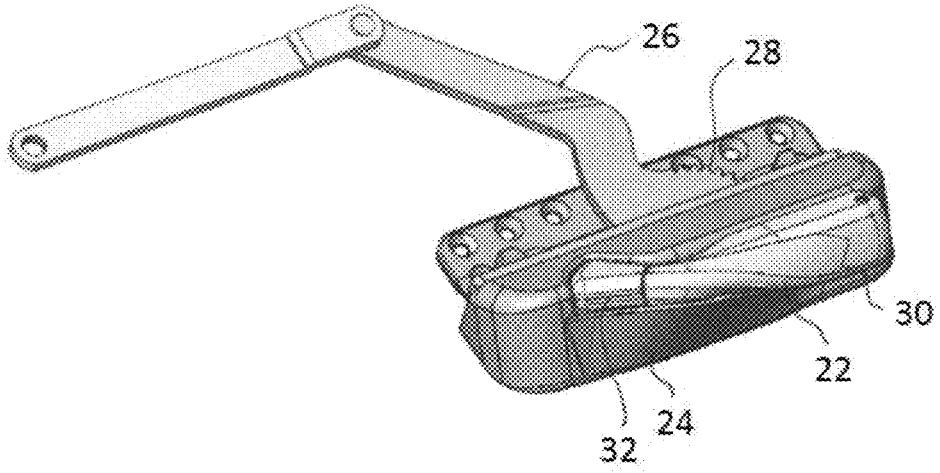
(PRIOR ART) FIG. 2
FIG. 2 is a perspective view of a prior art casement window operator.
Figure 3:
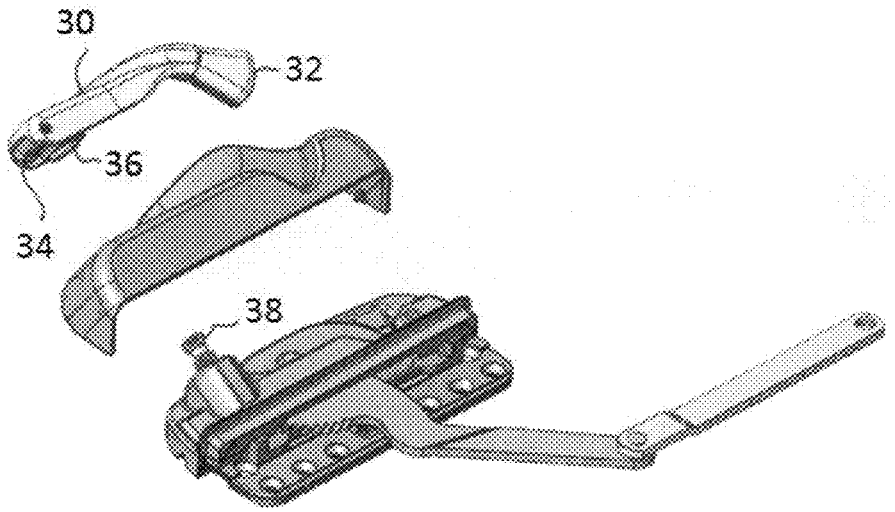
(PRIOR ART) FIG. 3
FIG. 3 is a partially exploded perspective view of the prior art casement window operator.
Figure 4:
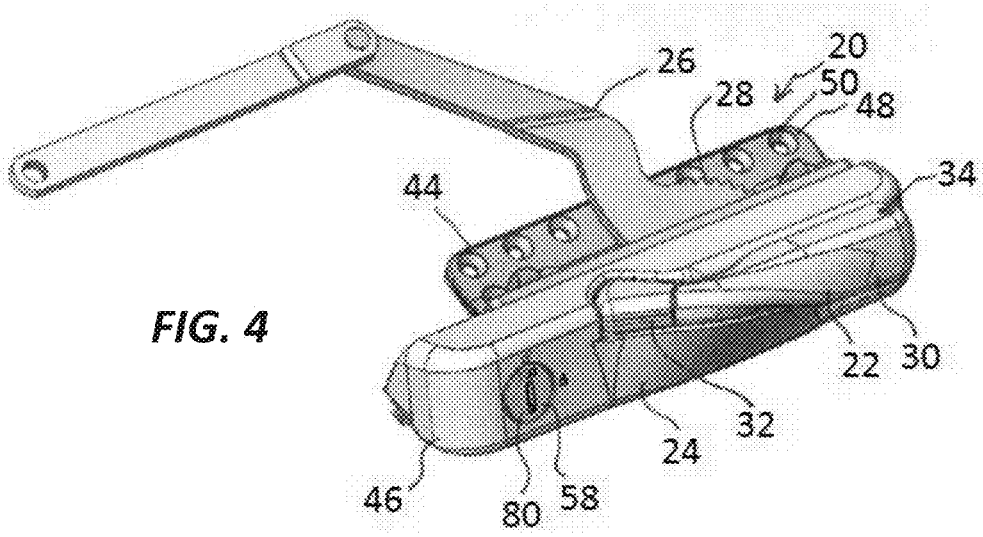
FIG. 4 is a perspective view of key lockable key operator according to an example embodiment of the invention.
Figure 5:
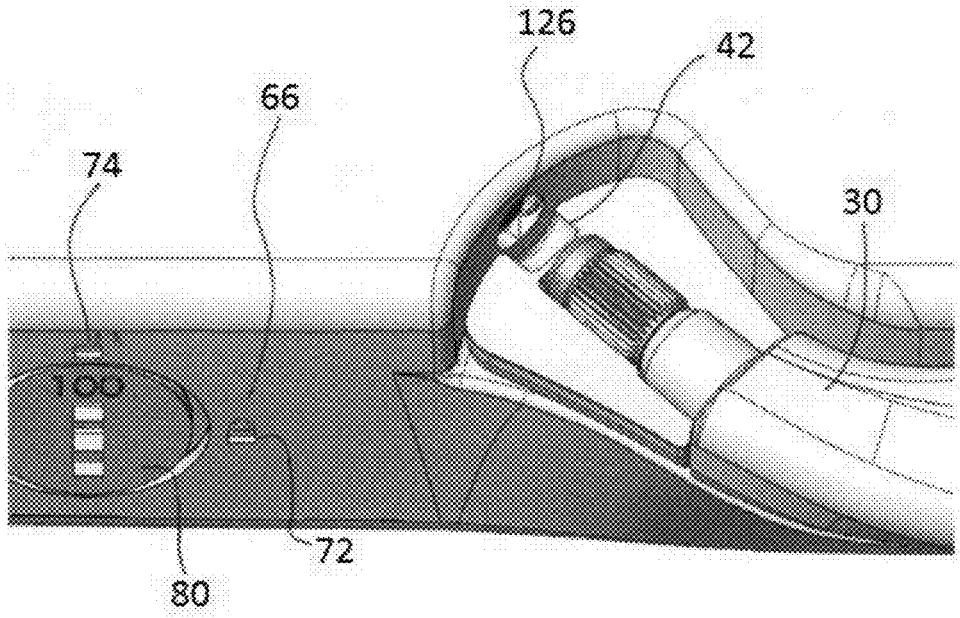
FIG. 5 is a detail perspective view of a key lockable operator according to an example embodiment of the invention in the unlocked state with a knob sectioned to show internal structures.
Figure 8:
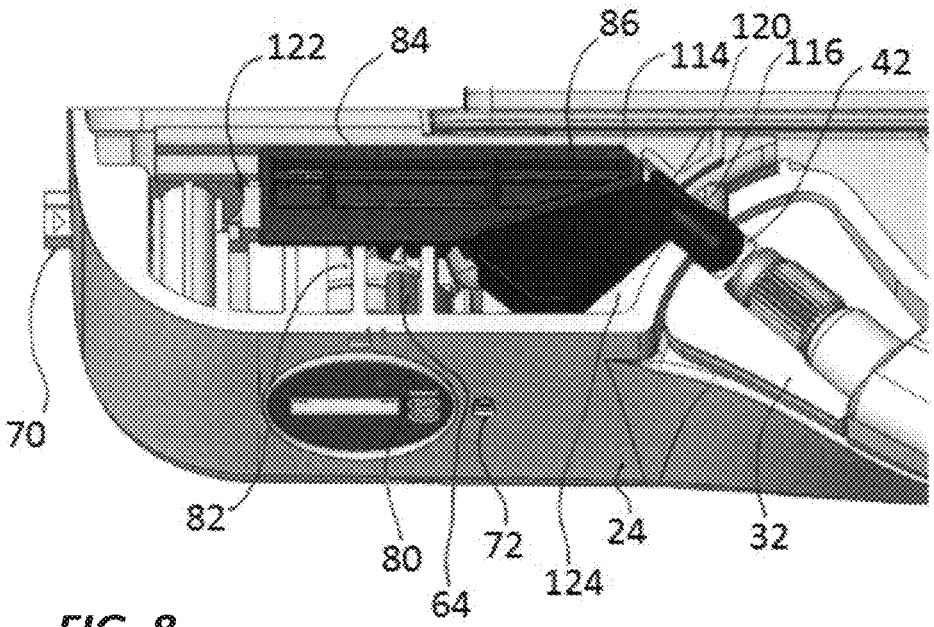
FIG. 8 is a sectional perspective view similar to FIG. 7 in the locked state.

Referring particularly to FIGS. 2-4, key lockable operator 20, according to an example embodiment of the invention generally includes handle 22, housing 24 and arm mechanism 26. Handle 22 is engaged to gear housing 24 and operates arm mechanism 26 by engagement of a worm gear (not shown) to gear portion 28 of arm mechanism 26. Prior art operators generally include the structures identified in this paragraph as well.

Handle 22 generally includes crank 30, knob 32, hinge 34, base 36 and axle 38. Knob 32 is secured as to be rotatable relative to crank 30. Crank 30 is pivotable about hinge 34 between a folded storage position and an unfolded operating position. Hinge 34 couples crank 30 to base 36. Base 36 is engaged to axle 38. Referring particularly to FIGS. 5-9, knob 32 includes body 40.

Figure 9:
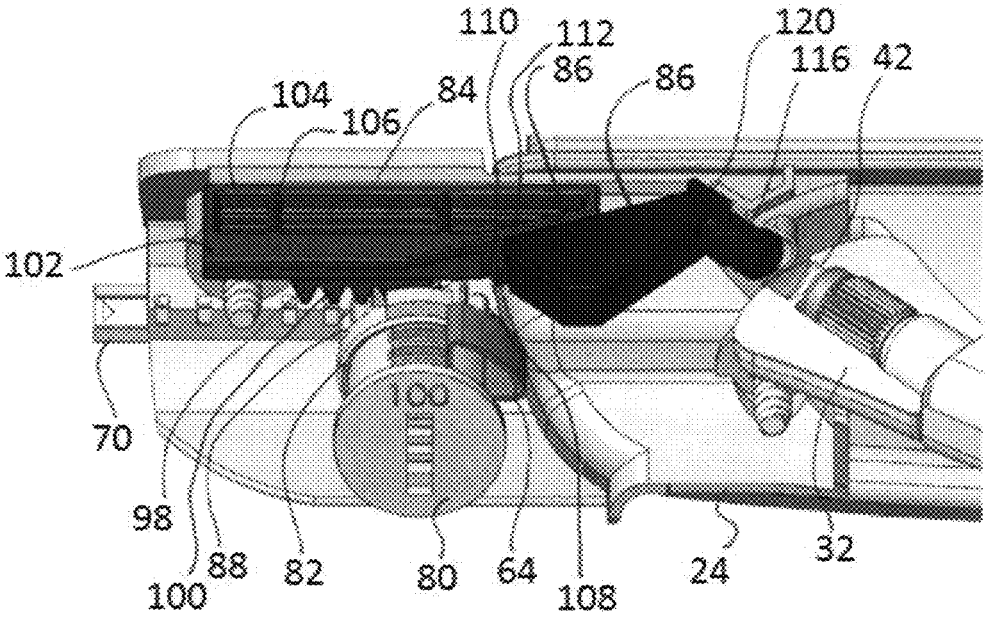
FIG. 9 is a perspective view of a lock assembly in the unlocked state with the cover removed.
Figure 12:
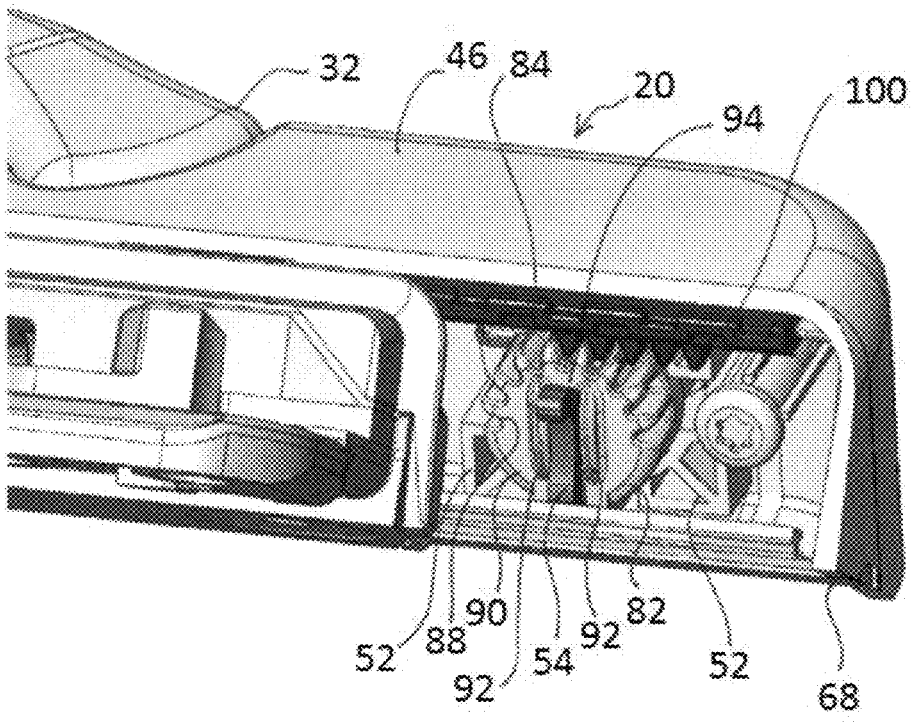
FIG. 12 is a rear perspective view with a back plate of the cover assembly removed showing the rack and pinion.

Referring particularly to FIGS. 4, 9 and 12, housing 24 generally includes base 44 and cover 46. Base 44 generally includes mounting plate 48, presenting mounting holes 50. Base 44 also includes lock cylinder supports 52 and pinion spring 54 as depicted in FIG. 12. Cover 46 generally includes lock assembly 58 and cover body 60. Lock assembly 58 is generally enclosed by cover body 60.

Referring particularly to FIG. 9, cover body 60 includes lock cylinder block 64 and presents surface indicia 66. Cover body 60 also defines pin passage 68 into which is received retaining pin 70.

Referring particularly to FIGS. 5-8, surface indicia 66 includes locked indicia 72 and unlocked indicia 74. Cover body 60 further includes detent 76, while retaining pin 70 presents detent groove 78.

Referring particularly to FIGS. 6-9 and 12-14, lock assembly 58 generally includes lock cylinder 80, pinion 82, rack 84 and sliding pin 86. Lock cylinder 80, pinion 82, rack 84 and sliding pin 86 are housed within cover 46 and supported generally by base 44. As best seen in FIGS. 9 and 12, lock cylinder 80 is coupled directly to pinion 82. Lock cylinder 80 is supported by lock cylinder supports 52 of base 44. Lock cylinder 80 is also bounded by lock cylinder block 64 of cover 46. In the depicted embodiment, lock cylinder 80 is directly coupled to pinion 82.

Referring particularly to FIGS. 9 and 12, pinion 82 in an example embodiment presents gear teeth portion 88 and smooth portion 90. Pinion 82 further presents parallel ridges 92 bounding spring space 94. While pinion 82 is depicted having gear teeth portion 88 and smooth portion 90, pinion 82 may have gear teeth extending the entire circumference thereof.

Referring to FIGS. 7-9 and 12-14, rack 84 is generally positioned to be slidable within base 44 and cover 46. Rack 84 is a generally unitary structure that includes rack portion 96 and ramp portion 98. Rack portion 96 presents linear gear teeth 100, which are structured to engage gear teeth portion 88 of pinion 82. Rack 84 is a generally unitary structure that can be formed by casting or molding of any materials of sufficient strength and rigidity. Rack 84 also presents flange 102, recess 104 and reinforcement 106.

Figure 13:
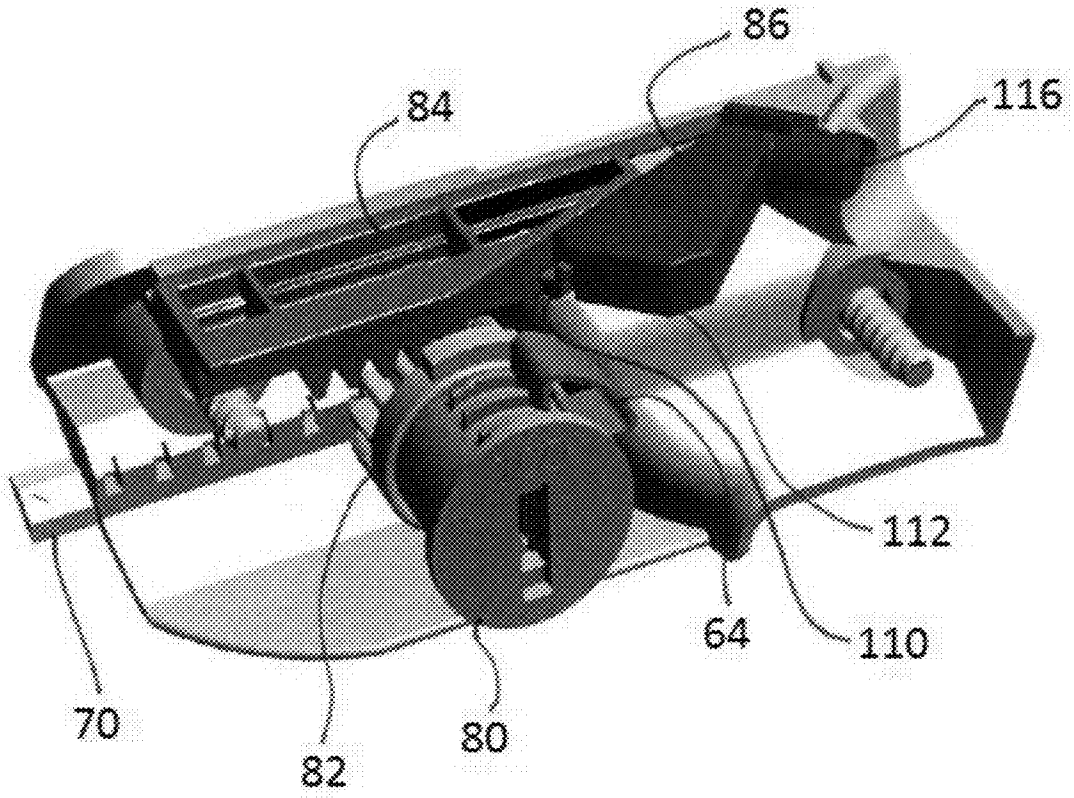
FIG. 13 is a perspective view of lock assembly with certain structures removed for clarity.
Figure 14:
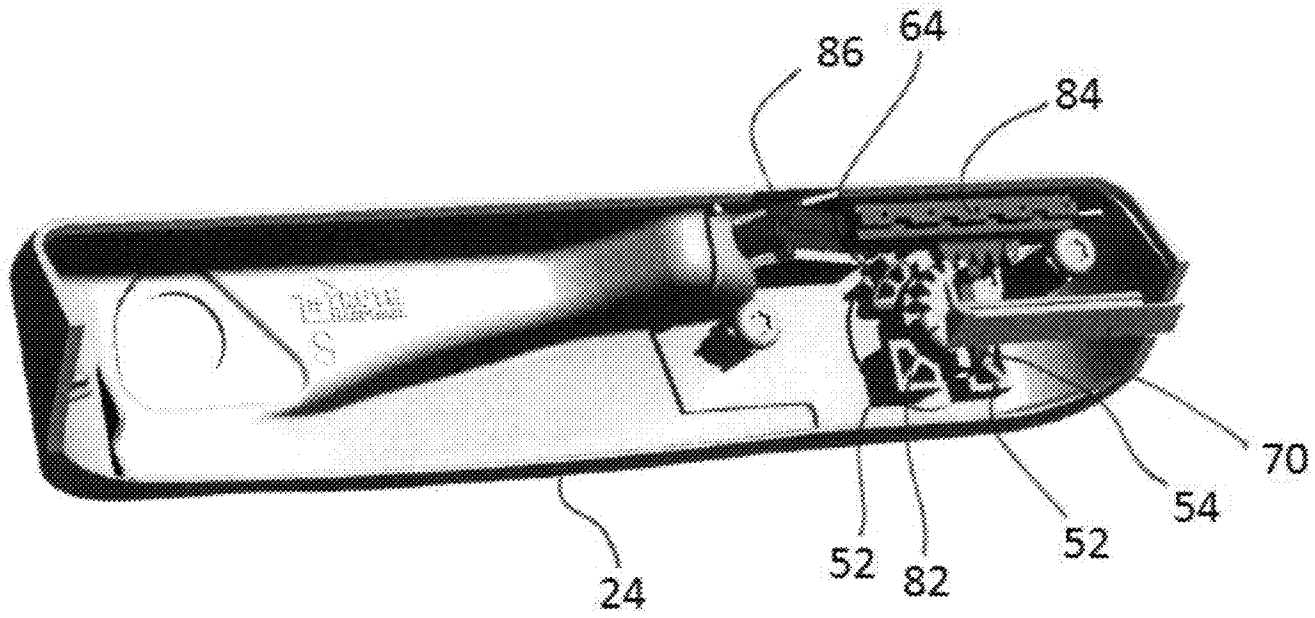
FIG. 14 is a rear perspective view of a lock assembly inside a cover with certain structures removed for clarity.

Ramp portion 98 presents pin engagement rail 108. As best seen in FIG. 13, pin engagement rail 108 generally includes outwardly extending portion 110 and upwardly extending portion 112. Outwardly extending portion 110 extends outwardly from ramp portion 98 and upwardly extending portion 112 extends upwardly from outwardly extending portion 110.

Sliding pin 86 is also a unitary structure which can be formed by, for example, casting or molding of any sufficiently rigid material. Sliding pin 86 generally includes body 114 and pin extension 116. Body 114, in the depicted embodiment, is a generally irregular hexagonal structure that is engaged to ramp portion 98 of rack 84. Body 114 defines rack engagement slot 118. Rack engagement slot 118 is structured to complement and interface with pin engagement rail 108. Pin engagement rail 108 also presents ridge 120 extending upwardly therefrom.

Rack 84 and sliding pin 86 are generally supported in a conforming structure of housing 24 within rack cavity 122 and pin cavity 124. Pin cavity 124 also includes locking pin passage 126.

For reference purposes, an example of casement window 200 is depicted in FIG. 1. Casement window 210 generally includes frame 212, sash 214, and operator mechanism 216. Frame 212 includes head jamb 218, sill 220, and sides 222 and defines window opening 224. Sash 214 includes top rail 226, bottom 228, side rails 230, and window pane 232. Sash 214 may also include screen 234. Sash 214 is typically coupled with hinges (not shown) to frame 212 and can be opened and closed through operation of operator mechanism 216.

In operation, key lockable operator 20 is secured to a casement or awning window such as casement window 200 via mounting holes 50. When it is desirable to lock key lockable operator 20, handle 22 is shifted to a folded position as depicted in FIG. 4. A key (not shown) is inserted into lock cylinder 80 and lock cylinder 80 is rotated from an unlocked position depicted in FIG. 5 to a locked position depicted in FIG. 6. As lock cylinder 80 is rotated, pinion 82 which is attached to lock cylinder 80 rotates therewith. At approximately 90° rotation of lock cylinder 80 and pinion 82, rack 84 shifts from an unlocked position as depicted in FIG. 7 to a locked position depicted in FIG. 8. Lock cylinder 80 engages lock cylinder block 64 when the key (not shown) is removed from lock cylinder 80 and either the locked or unlocked state.

As rack 84 shifts from the unlocked position to the locked position, ramp portion 98 which engages sliding pin 86, bears against body 114 of sliding pin 86. Pin engagement rail 108 of rack 84 couples to rack engagement slot 118 of sliding pin 86. As rack 84 is shifted to the locked position, sliding pin 86 is moved forward in a direction diagonal to the motion of rack 84.

As sliding pin 86 moves on its diagonal path, pin extension 116 passes through locking pin passage 126 and into pin receiving cavity 42 of knob 32. Thus, knob 32 is secured to housing 24 and unauthorized persons are inhibited from shifting crank 30 from a folded position to an operating position. Crank 30 can be secured with window 100 in a variety of positions including fully closed, fully opened and at least one position in between.

When it is desired to unlock key lockable operator 20, a key (not shown) is inserted into lock cylinder 80 and lock cylinder 80 is rotated approximately 90° in a counter clockwise direction. Pinion 82 engages with rack 84 and shifts rack 84 from a locked position to an unlocked position. As rack 84 is shifted, sliding pin 86 follows rack 84 because of the engagement between pin engagement 108 and rack engagement slot 118. Thus, sliding pin 86 is withdrawn in a direction diagonal to that of the direction of travel of rack 84. Pin extension 116 is thus withdrawn from pin receiving cavity 42 in knob 32 freeing crank 30 to be shifted from the folded position to the operating position.

Figure 10:
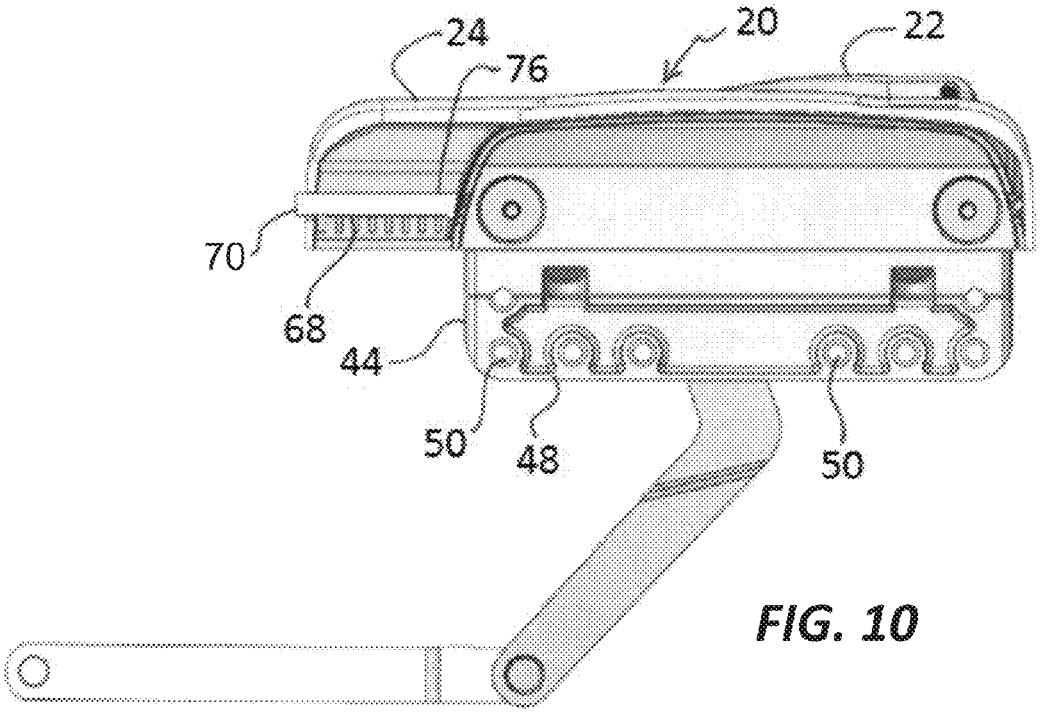
FIG. 10 is a bottom plan view of a key lockable operator according to an example embodiment of the present invention showing a retaining pin in a withdrawn position for installation.
Figure 11:
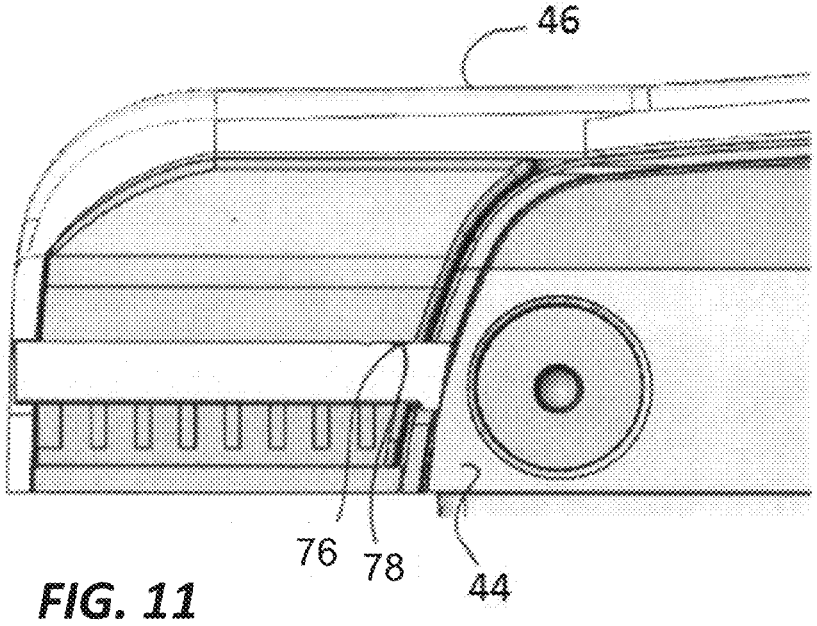
FIG. 11 is a detailed bottom perspective view showing a retaining pin extended into engagement with the operator.

Referring particularly to FIGS. 10 and 11, when key lockable operator 20 is installed and assembled, retaining pin 70 is located in a retracted position as depicted in FIG. 10. Once housing 24 is fully assembled by placing cover 46 over base 44, retaining pin 70 may be advanced to a position depicted in FIG. 11 where retaining pin 70 is secured to base 44 thus securing cover 46 to base 44 and inhibiting unauthorized removal of cover 46 from base 44. As can be seen in FIG. 11, detent groove 78 of retaining pin 70 engages detent 77 thus holding retaining pin in a secured position. It is further notable in FIG. 11 that retaining pin 70 is slightly below the surface of cover 46 thus making retraction of retaining pin 70 difficult for unauthorized persons.

The foregoing descriptions present numerous specific details that provide a thorough understanding of various embodiments of the invention. It will be apparent to one skilled in the art that various embodiments, having been disclosed herein, may be practiced without some or all of these specific details. In other instances, components as are known to those of ordinary skill in the art have not been described in detail herein in order to avoid unnecessarily obscuring the present invention. It is to be understood that even though numerous characteristics and advantages of various embodiments are set forth in the foregoing description, together with details of the structure and function of various embodiments, this disclosure is illustrative only. Other embodiments may be constructed that nevertheless employ the principles and spirit of the present invention. Accordingly, this application is intended to cover any adaptations or variations of the invention.

For purposes of interpreting the claims for the present invention, it is expressly intended that the provisions of 35 U.S.C. §112(f) are not to be invoked unless the specific terms "means for" or "step for" are recited in a claim.

What is claimed is:

1. A casement window system comprising:

a frame;

a sash hinged to the frame and shiftable between a window closed position in which the sash is received in the frame and a window open position in which the sash is swung outwardly from the frame; and a window operator operably coupling the frame and the sash and arranged to shift the sash between the window open and the window closed position, the window operator comprising:

a housing;

an arm mechanism;

a crank handle for operating the arm mechanism to shift the sash between the window open and the window closed position, the handle being shiftable between a folded storage position and an unfolded operating position; and a handle locking mechanism including a lock cylinder contained in the housing, the lock cylinder operable with a key to shift a retaining pin operably coupled to the lock cylinder between a locked position in which the retaining pin engages and retains the crank handle in the folded storage position and an unlocked position in which the retaining pin is disengaged from the crank handle to enable the crank handle to be freely shiftable between the folded storage position and the unfolded operating position.

2. The casement window system of claim 1, wherein the lock cylinder is operably coupled to the retaining pin with a rack and pinion.

3. The casement window system of claim 2, wherein a rack of the rack and pinion shifts position along a first rectilinear path and the retaining pin shifts position along a second rectilinear path that is oriented diagonal with the first rectilinear path.

4. The casement window system of claim 1, wherein the housing defines a recess for receiving the crank handle when the crank handle is in the folded position.

5. The casement window system of claim 1, wherein the crank handle defines a recess for receiving the retaining pin.

6. The casement window system of claim 5, wherein the recess defined by the crank handle is disposed in a distal end of the crank handle.

* * * * *